US008859918B2

(12) United States Patent
Sisley et al.

(10) Patent No.: US 8,859,918 B2
(45) Date of Patent: Oct. 14, 2014

(54) CIRCUIT BREAKER TERMINAL SHIELD WITH POSITION INDICATOR

(71) Applicant: Eaton Corporation, Cleveland, OH (US)

(72) Inventors: James Patrick Sisley, Baden, PA (US); Richard Paul Malingowski, McDonald, PA (US); Craig Joseph Puhalla, Moon Township, PA (US); Kelly Julia McCarthy, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 216 days.

(21) Appl. No.: 13/705,208

(22) Filed: Dec. 5, 2012

(65) Prior Publication Data

US 2014/0151201 A1 Jun. 5, 2014

(51) Int. Cl.

| | |
|---|---|
| ***H01H 1/64*** | (2006.01) |
| ***H01H 71/02*** | (2006.01) |
| ***H01H 9/02*** | (2006.01) |
| ***H01H 71/08*** | (2006.01) |
| ***H01R 13/641*** | (2006.01) |
| *H01R 13/447* | (2006.01) |
| *H01R 4/36* | (2006.01) |

(52) U.S. Cl.

CPC ..... *H01H 71/0207* (2013.01); *H01H 9/0264* (2013.01); *H01H 71/08* (2013.01); *H01R 13/641* (2013.01); *H01R 13/447* (2013.01); *H01R 4/36* (2013.01)

USPC ..... 200/293; 200/304; 335/202

(58) Field of Classification Search

USPC ..... 200/304, 305; 361/673; 335/202

See application file for complete search history.

(56) References Cited

U.S. PATENT DOCUMENTS

| | | | | |
|---|---|---|---|---|
| 4,754,162 | A * | 6/1988 | Kondou et al. | 307/112 |
| 5,150,091 | A | 9/1992 | Hart et al. | |
| 5,933,066 | A * | 8/1999 | Chontas et al. | 335/202 |

(Continued)

FOREIGN PATENT DOCUMENTS

| | | |
|---|---|---|
| EP | 1 770 729 A1 | 4/2007 |
| FR | 2 720 863 A1 | 12/1995 |

(Continued)

OTHER PUBLICATIONS

European Patent Office, "International Search Report and Written Opinion", Mar. 12, 2014, 13 pp.

*Primary Examiner* — Renee Luebke
*Assistant Examiner* — Ahmed Saeed
(74) *Attorney, Agent, or Firm* — Eckert Seamans Cherin & Mellott, LLC; David C. Jenkins

(57) ABSTRACT

A position indicator for a circuit breaker is provided. A circuit breaker housing assembly body has an alignment surface. The position indicator includes an indicator member having an alignment surface and an elongated spacer member. The indicator member is movably coupled to the circuit breaker housing assembly adjacent a terminal screw with the spacer member generally aligned with the terminal screw. The indicator member is structured to move between a first position, wherein the alignment surface is not aligned with the housing assembly body alignment surface, and a second position, wherein the alignment surface is aligned with the housing assembly body alignment surface. The spacer member engages the terminal screw and, if the terminal screw is in a terminal screw first position, the spacer member prevents the indicator member from moving into the indicator member second position.

19 Claims, 7 Drawing Sheets

(56) References Cited

U.S. PATENT DOCUMENTS

| | | | | |
|---|---|---|---|---|
| 6,144,001 | A * | 11/2000 | Green et al. | 200/304 |
| 6,838,960 | B2 * | 1/2005 | Asakawa et al. | 335/132 |
| 6,930,577 | B2 * | 8/2005 | Subramanian et al. | 335/202 |
| 8,759,697 | B2 * | 6/2014 | Polston et al. | 200/303 |

FOREIGN PATENT DOCUMENTS

| | | | |
|---|---|---|---|
| FR | 2 865 573 | A1 | 7/2005 |
| JP | 2002 163973 | A | 6/2002 |
| WO | 01/16974 | A1 | 3/2001 |

* cited by examiner

CIRCUIT BREAKER TERMINAL SHIELD WITH POSITION INDICATOR

BACKGROUND OF THE INVENTION

1. Field of the Invention

The disclosed concept relates generally to a molded case circuit breaker and, more specifically, to a molded case circuit breaker including a terminal shield wherein the terminal shield includes a position indicator than provides a visual indication that the terminal shield is not in a seated position when the circuit breaker terminal screws are not set.

2. Background Information

A circuit breaker, such as but not limited to a molded case circuit breaker, includes a non-conductive housing assembly that encloses a pair of separable contacts, an operating mechanism, a trip device, and other components. External to the enclosed space, the circuit breaker includes terminal, assemblies. The terminal assemblies are coupled to and in electrical communication with, conductors that extend into the enclosed space and are in electrical communication with the separable contacts. The terminal assemblies further include a conductive terminal body. The terminal body is structured to be coupled to, and placed in electrical communication with, an external conductor, typically a line or load conductor.

The external conductor may be, but is not limited to, a generally cylindrical cable. As such, the terminal assembly body may define a circular bore or opening into which the cable may be placed. Alternatively, the external conductor may be a bus bar having a rectangular cross-section. Thus, a terminal assembly body may also define a rectangular opening.

The terminal assembly further includes a terminal screw. The terminal screw is movably coupled to the terminal and is structured to secure the external conductor to the terminal body. That is, the terminal screw is structured to move between two positions, a first position, wherein the terminal screw is not set, and a second position, wherein the terminal screw is set. For example, the terminal body may include a threaded bore that is contiguous with the opening for the external conductor, When the terminal screw is in the first position, the terminal screw does not bias the external conductor against the terminal body. When the external conductor is disposed in the terminal body bore, or other opening, and the terminal screw is moved into the set, second position, the terminal screw biases the external conductor against the terminal body. That is, the terminal screw is drawn tight against the external conductor. In this configuration, the external conductor provides a secure connection to the terminal assembly body.

The terminal screw is, typically, disposed in a bore in the circuit breaker housing, or, is structured to have a terminal shield placed thereover. As such, the terminal screw, and more specifically the position of the terminal screw, may not be visible. This may lead to a situation wherein the terminal screw is not in the second position. For example, during installation of the circuit breaker, a user may position the external conductor in the terminal body but may choose to not tighten the terminal screw initially or may simply forget to tighten the terminal screw at that time. With the terminal screw position not visible, the user may forget, or not notice, that the terminal screw is not in the second position. If the circuit breaker is used in this configuration, the electric coupling may become damaged, overheat, damage the external conductor, may become dangerous during an over-current (fault) condition, or suffer from other detrimental effects of an external conductor that is not sufficiently biased against the terminal.

As such, there is a need for an indicator structured to indicate the position of the terminal screw. There is a further need for an indicator that is simple to construct and operate.

SUMMARY OF THE INVENTION

These needs, and others, are met by at least one embodiment of the disclosed concept that provides for a position indicator coupled to the circuit breaker housing assembly, wherein the housing assembly body has an alignment surface, the position indicator including an indicator member having an alignment surface and an elongated Spacer member. The spacer member is coupled to the indicator member and extends away from the indicator member alignment surface. The indicator member is movably coupled to the circuit breaker housing assembly adjacent a terminal screw with the spacer member generally aligned with the terminal screw. The indicator member is structured to move between a first position, wherein the alignment surface is not aligned with the housing assembly body alignment surface, and a second position, wherein the alignment surface is aligned with the housing assembly body alignment surface. The spacer member engages the terminal screw and, if the terminal screw is in the terminal screw first position, the spacer member prevents the indicator member from moving into the indicator member second position.

When the terminal screw is in the terminal screw first position, the indicator member is in the first position, wherein the alignment surface is not aligned with the housing assembly body alignment surface. The lack of alignment between the two alignment surfaces is easily visible to a user. Thus, a user may easily determine if the terminal screw is in the first or second position.

The indicator member may be incorporated into, or disposed upon, a terminal shield. A terminal shield may be used with a three-pole circuit breaker haying external terminal bodies. The terminal shield, typically, has a cross-sectional shape that is similar to the circuit breaker housing assembly. Thus, when the terminal shield is installed, i.e. aligned with the circuit breaker housing assembly body, it may appear to be an extension of the circuit breaker housing assembly body. When the indicator member and spacer member are incorporated into, or attached to, the terminal shield, and when the terminal screw is in the first position, the terminal shield is prevented from moving into an aligned configuration with the circuit breaker housing assembly body, Again, this lack of alignment is easy for a user to see.

Thus, the disclosed concept further includes a terminal shield for a circuit breaker housing assembly, the circuit breaker housing assembly including a body, the housing assembly body including an alignment surface and a first end, a terminal assembly including three terminals including a first terminal, second terminal, and a third terminal, each terminal including an elongated terminal screw, each terminal body defining a fastener passage and a conductor passage, each terminal screw disposed in a terminal fastener passage, each terminal screw structured to move between two positions, a first position, wherein the terminal screw is not set, and a second position, wherein the terminal screw is set, each terminal coupled to the housing assembly body first end and disposed in a spaced parallel relationship, the terminal shield including a terminal shield body including a generally planar member having an upper surface and a lower surface, an indicator member including an alignment surface disposed on the planar member upper surface, three elongated spacer members, each spacer member coupled to the indicator member and extending away from the indicator member alignment surface, the planar member movably coupled to the circuit breaker housing assembly adjacent a terminal screw with each spacer member aligned with a terminal screw, the indicator member structured to move between a first position, wherein the alignment surface is not aligned with the housing assembly body alignment surface, and a second position, wherein the alignment surface is aligned with the housing assembly body alignment surface, and wherein each spacer member engages a terminal screw and, if the terminal screw is in the terminal screw first position, the spacer member prevents the indicator member from moving into the indicator member second position.

BRIEF DESCRIPTION OF THE DRAWINGS

A full understanding of the invention can be gained from the following description of the preferred embodiments when read in conjunction with the accompanying drawings in which:

FIG. 2A shows a terminal screw in a first position, wherein the terminal screw is not set. FIG. 2B shows a terminal screw in a second position, wherein the terminal screw is set.

FIG. 6A shows an alternate position indicator with a terminal screw in a first position, wherein the terminal screw is not set. FIG. 6B shows an alternate position indicator with a terminal screw in a second position, wherein the terminal screw is set.

DESCRIPTION OF THE PREFERRED EMBODIMENTS

Figure 1:
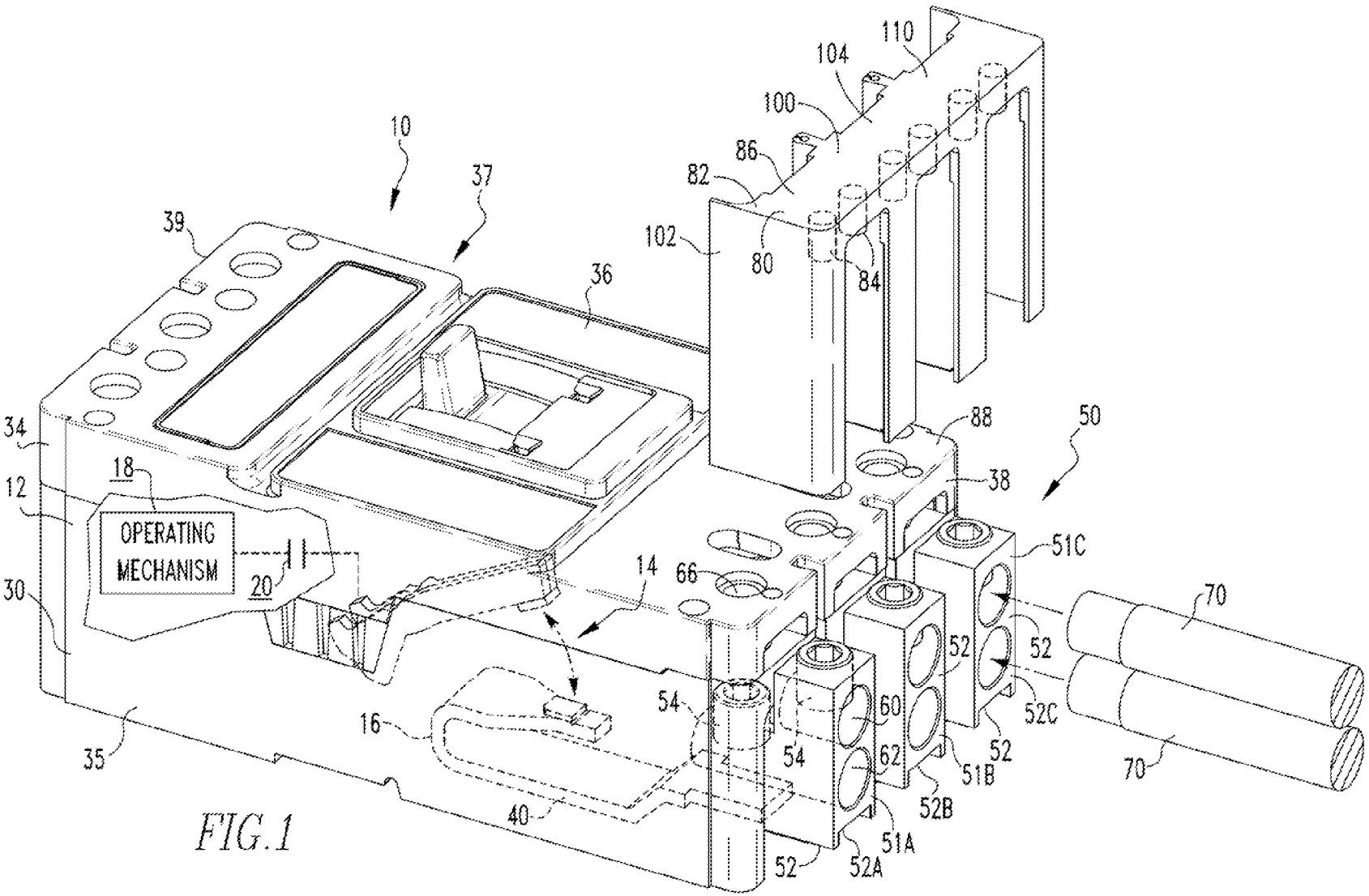
FIG. 1 is an isometric schematic view of a circuit breaker.

As used herein "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created. as a single piece or unit. That is, a component that includes pieces that are created separately and then coupled together as a unit is not a "unitary" component or body.

As used herein, the statement that two or more parts or components "engage" one another shall means that the parts exert a force against one another either directly or through one or more intermediate parts or components.

As used herein, "tightly engage" when used in reference to a terminal screw and an external conductor means that terminal screw engages the external conductor with sufficient force to avoid the detrimental effects of an external conductor that is not sufficiently biased against the terminal.

As used herein, the singular form of "a," "an," and "the" include plural references unless the context clearly dictates otherwise.

Directional phrases used herein, such as, for example and without limitation, top, bottom, left, right, upper, lower, front, back, and derivatives thereof, relate to the orientation of the elements shown in the drawings and are not limiting upon the claims.

As used herein in reference to elongated elements, such as but not limited to a terminal screw and an elongated spacer member, "aligned" means disposed generally along the same line or along a parallel, but offset, lines.

As used herein in reference to planar elements, "aligned" means two surfaces are disposed generally in the same plane. It is noted that two abutting planar surfaces are disposed generally in the same plane.

For surfaces having other shapes, such as but not limited to curved or spherical contours, "aligned" means that at the interface of two surfaces, the two surfaces are disposed generally in the same plane whereas portions of the surface spaced from the interface may be in other planes.

As shown in FIG. 1, a circuit breaker 10 includes a housing assembly 12, a pair of separable contacts 14, a conductor assembly 16, an operating mechanism, 18 and a trip device 20. The housing assembly 12 includes a body 30 that defines an enclosed space. The separable engages 14, conductor assembly 16, operating mechanism 18, and trip device 20 are substantially disposed in the enclosed space. The separable contacts 14 are structured to move between two positions; a first position, wherein the separable contacts 14 are spaced from each other, and a second position, wherein the separable contacts 14 are coupled and in electrical communication. The operating mechanism 18 is structured to move the separable contacts between the two positions and may also reset the trip device 20 as well as other functions. The trip device 20 is structured to move the separable contacts 14 from the second position to the first position upon an over current event. The conductor assembly 16 includes a number of conductive bus members 40. A bus member 40 is coupled to, and in electrical communication with each contact in the pair of separable contacts 14. The distal ends of the bus members 40 extend outside the enclosed space and are coupled to, and in electrical communication with a terminal assembly 50, described below. The circuit breaker 10 may have more than one pair of separable contacts 14 and, in an exemplary embodiment, there are three pairs of separable contacts 14 in the circuit breaker 10.

In an exemplary embodiment, the housing assembly body 30 is a molded, non-conductive material. The housing assembly body 30 includes removable elements such as, but not limited to a cover 34. As shown, the housing assembly body 30, and more specifically the cover 34, includes a generally planar upper surface 36. As shown, the housing assembly body 30 is a generally cuboid, i.e. a generally rectangular box having a length, width, and depth. In this configuration, the housing assembly body 30 includes a first end 38 and a second end 39 as well as a first lateral side 35 and a second lateral side 37. It is understood that the housing assembly body 30 may have other shapes. When the housing assembly body 30, and more specifically the cover 34, includes a generally planar upper surface 36, the planar upper surface 36 may act as an alignment surface 86, as described below.

Figure 2A:
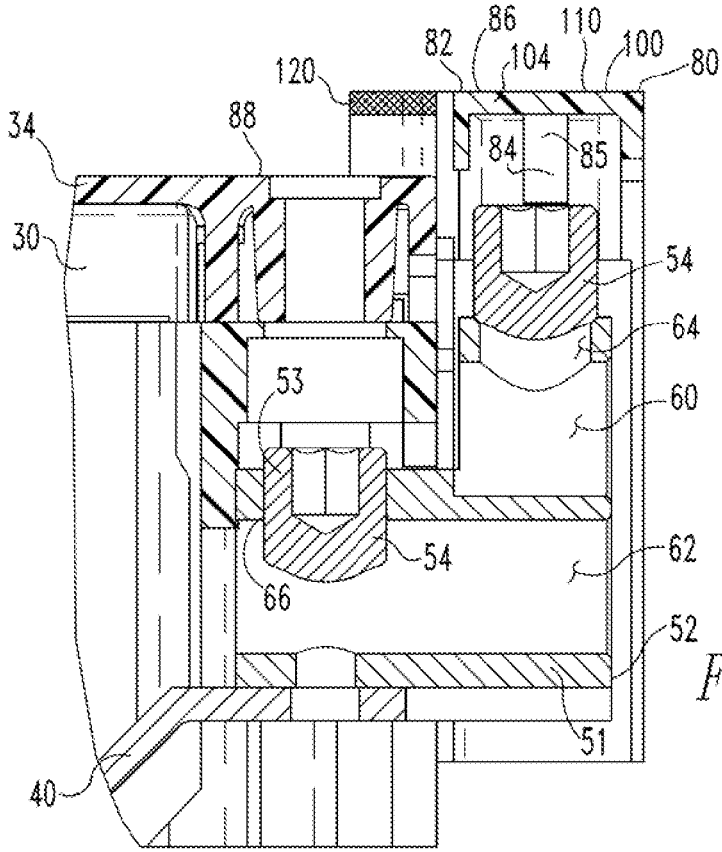
FIGS. 2A and 2B are detailed cross-sectional side views of a circuit breaker first end with a terminal.
Figure 2B:
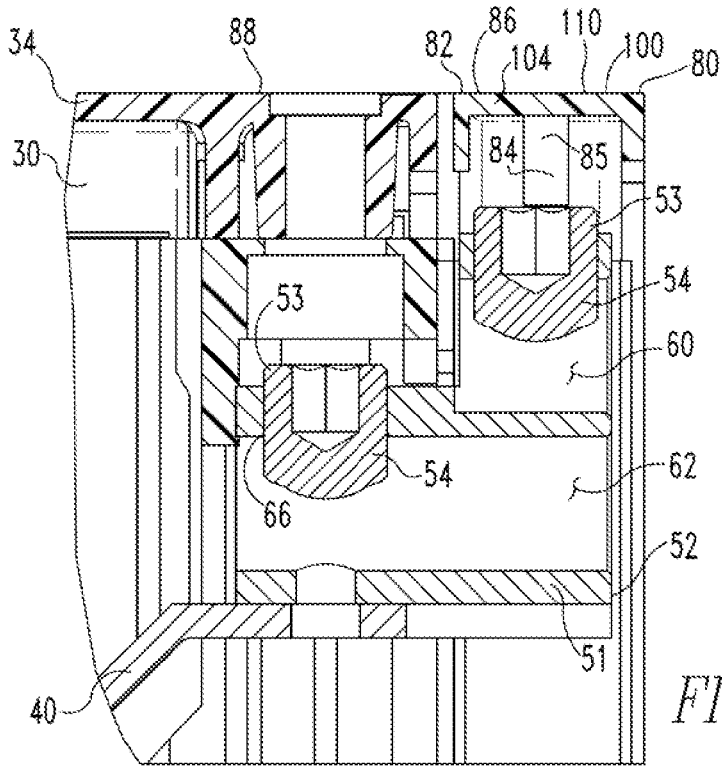
Figure 4:
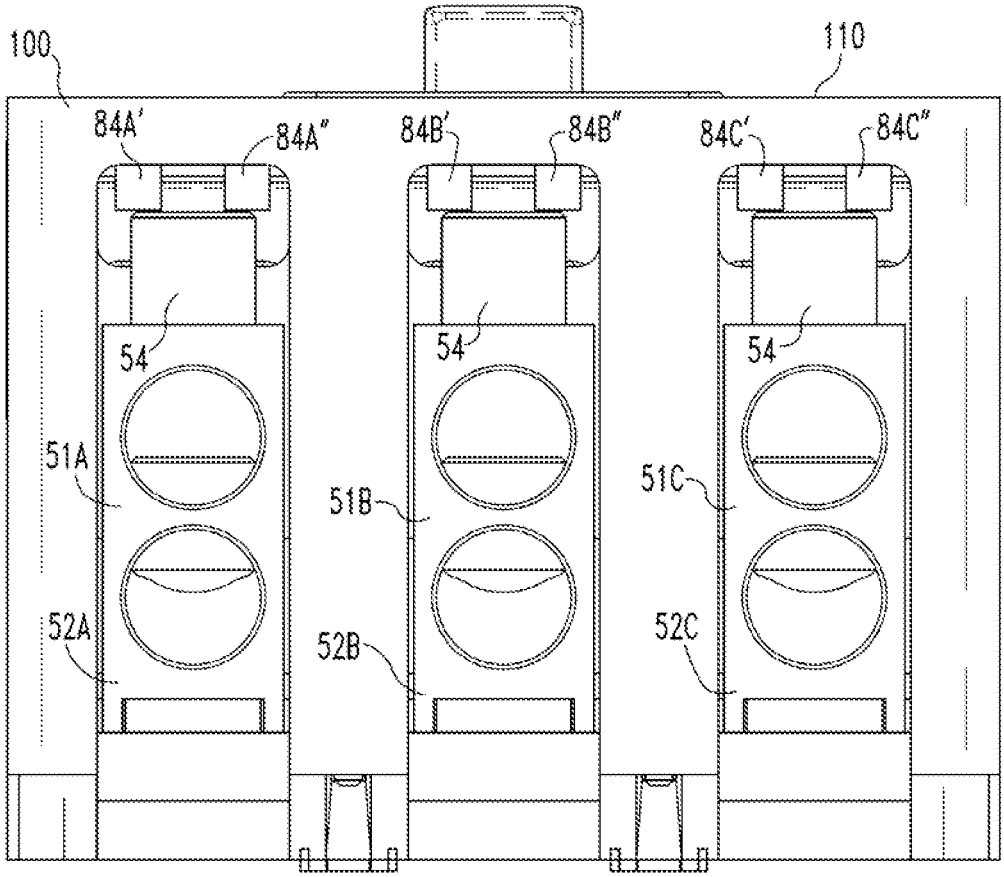
FIG. 4 is an end view of a terminal shield in a first position.
Figure 5:
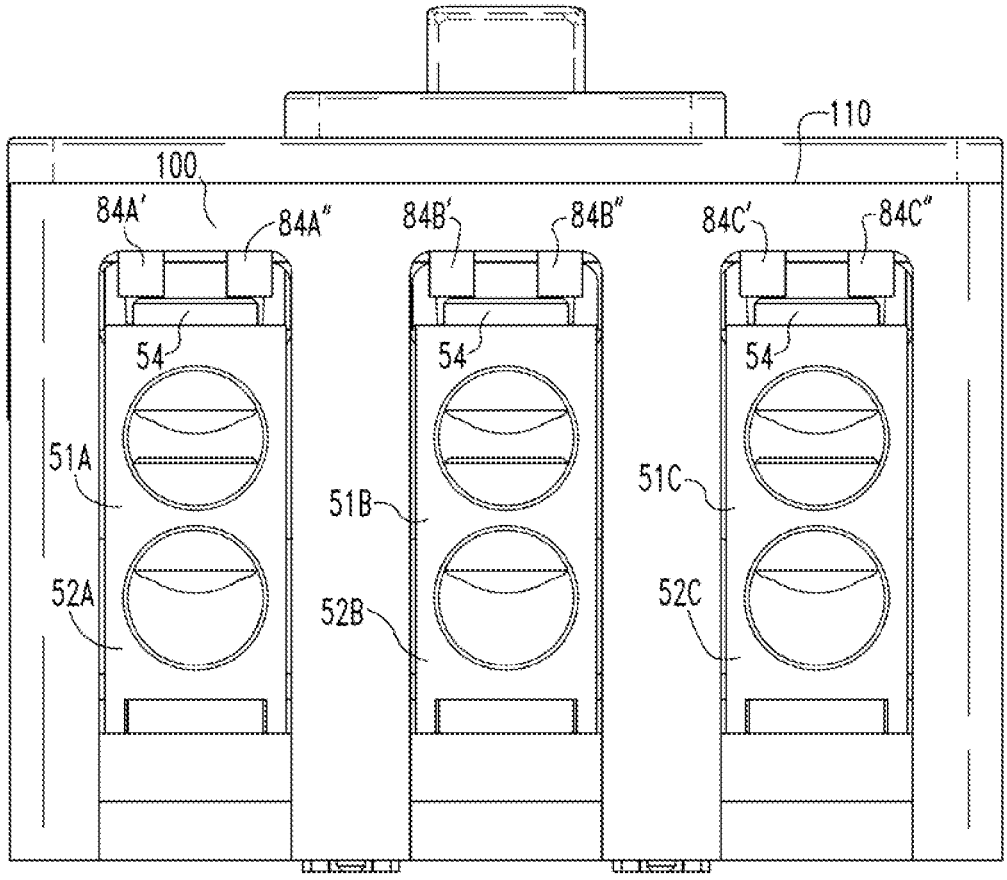
FIG. 5 is an end view of a terminal shield in a second position.

As shown in FIGS. 2A and 2B, the distal ends of the bus members 40, i.e. the ends of the bus members 40 distal to the separable contacts 14, extend from the housing assembly body 30 at the first end 38, it is understood that another set of bus members 40 coupled to the other of the separable contacts 14 may extend from the housing assembly body second end 39. The circuit breaker 10, and more specifically the conductor assembly 16, includes a terminal assembly 50 having a number of terminals 51. Each terminal 51 includes a terminal body 52 and a terminal fastener 53, such as but not limited to, a terminal screw 54, There is one terminal 51, i.e. one terminal body 52, for each pair of separable contacts 14 and more specifically a terminal body 52 for each bus member 40, of the circuit breaker 10. Thus, in the exemplary embodiment as shown in FIGS. 1, 4, and 5, there are three terminals 51A, 51B, 51C, and therefore three terminal bodies 52A, 52B, 52C at the housing assembly body first end 38. Each terminal body 52A, 52B, 52C is coupled to, and in electrical communication with, a different bus member 40 (FIG. 2). The terminals 51, and more specifically the terminal bodies 52A, 52B, 52C, are disposed in a spaced parallel relationship. As used herein, a "spaced parallel relationship" means that the terminal bodies 52A, 52B, 52C are disposed in the same general orientation with at least one surface being, aligned with a similar surface on an adjacent terminal body 52A, 52B, 52C. By virtue of being in a "spaced" parallel relationship, and as used herein, it is inherent that the terminal bodies 52A, 52B, 52C have a gap between each other. As the terminal bodies 52A, 52B, 52C are substantially similar, a single terminal body 52 will be discussed below; it is understood that this description applies to each terminal body 52A, 52B, 52C.

As shown, the terminal body 52 is a double lug terminal. That is, the terminal body 52 defines two conductor passages 60, 62. As shown, the upper conductor passage 60 has a shorter length than the lower conductor passage 62. Each conductor passage 60, 62 is structured to have an external conductor 70 disposed therein. As shown, the external conductor 70 has a generally circular cross-sectional shape. It is understood, however, that the external conductor 70 may have any cross-sectional shape. The terminal body 52 also defines two terminal fastener passages 64, 66. Each terminal fastener passage 64, 66 is contiguous with one of the two conductor passages 60, 62. The terminal fastener passages 64, 66 are threaded. A terminal screw 54 is disposed in each terminal fastener passage 64, 66. Each terminal screw 54 is structured to move between two positions, a first position, wherein the terminal screw 54 is not set, and a second position, wherein the terminal screw 54 is set. The terminal screw 54 is in the second, set position when the terminal screw 54 is at a predetermined position structured to tightly engage external conductor 70 disposed in a conductor passage 60, 62. Thus, the exact location of the terminal screw 54 second position varies with the size of the conductor passage 60, 62 and the external conductor 70 disposed therein. As these dimensions may be determined for each terminal 51, the location of the terminal screw 54 second position may be determined as well. Further, the terminal screw 54 first position does not require the terminal screw 54 to he at its maximum withdrawn position; any position that is not the second position, is a first position.

When the terminal screw 54 is set, i.e. in the second position, the terminal screw 54 is at least partially disposed in the conductor passage 60, 62 that is contiguous with terminal fastener passage 64, 66. Thus, when an external conductor 70 is disposed in a terminal fastener passage 64, 66 and the terminal screw 54 is set, i.e. in the second position, the terminal screw 54 biases the external conductor 70 against the surface of the conductor passages 60, 62 opposing the terminal fastener passage 64, 56. It is understood that the terminal body 52 may he a single lug terminal having a single conductor passage and a single terminal fastener passage (not shown).

A position indicator 80 is structured to indicate the position of each terminal screw 54 or a group of terminal screws 54. The position indicator 80 includes an indicator member 82 and a spacer member 84. The indicator member 82 may include an alignment surface 86. The housing assembly body 30, and more specifically the cover 34, generally planar upper surface 36 is also an alignment surface 88. In this embodiment, the indicator member alignment surface 86 and the housing assembly body alignment surface 88 are generally planar. It is understood that, if the housing assembly body 30 had a different shape, and therefore the housing assembly body alignment surface 88 has a different shape (not shown), the indicator member alignment surface 86 would also have a corresponding, shape. That is, as used herein, an "alignment surface" is one of a pair of "alignment surfaces" having similar features, e.g. contours, such that a user may easily see when the "alignment surfaces" are aligned or not aligned. For example, when the "alignment surfaces" are generally planar surfaces, the "alignment surfaces" are aliened when they are disposed generally in the same plane. That is, a user may easily see when such planar "alignment surfaces" are disposed in parallel but offset planes, or, when the planar "alignment surfaces" are not disposed generally in the same plane, i.e. angled relative to each other. It is further noted that, as used herein, an "alignment surface" is visible to a user; thus, surfaces disposed within bores or otherwise enclosed are not "alignment surfaces."

The spacer member 84 includes an elongated body 85 that may be generally cylindrical, however it can be any other shape. The spacer member 84 is aligned along the axis of the terminal screw 54. When the indicator member 82 moves from the first position to the second position, as described below, the spacer member 84 moves toward the terminal screw 54. lithe terminal screw 54 is in the first position, i.e. is not set, then the spacer member 84 engages the terminal screw 54. The engagement of the spacer member 84 with the terminal screw 54 prevents the spacer member 84 from moving toward the terminal screw and therefore prevents the indicator member 82 from moving toward the second position. That is, if the terminal screw 54 is in the first position, i.e. when the terminal screw 54 is not set, then the indicator member 82 cannot be moved into the second position. It is noted that the length of the spacer member 84 is determined based upon the dimensions of the terminal 51, the external conductor 70, and the location of the terminal screw 54 when it is in the second position.

Figure 3:
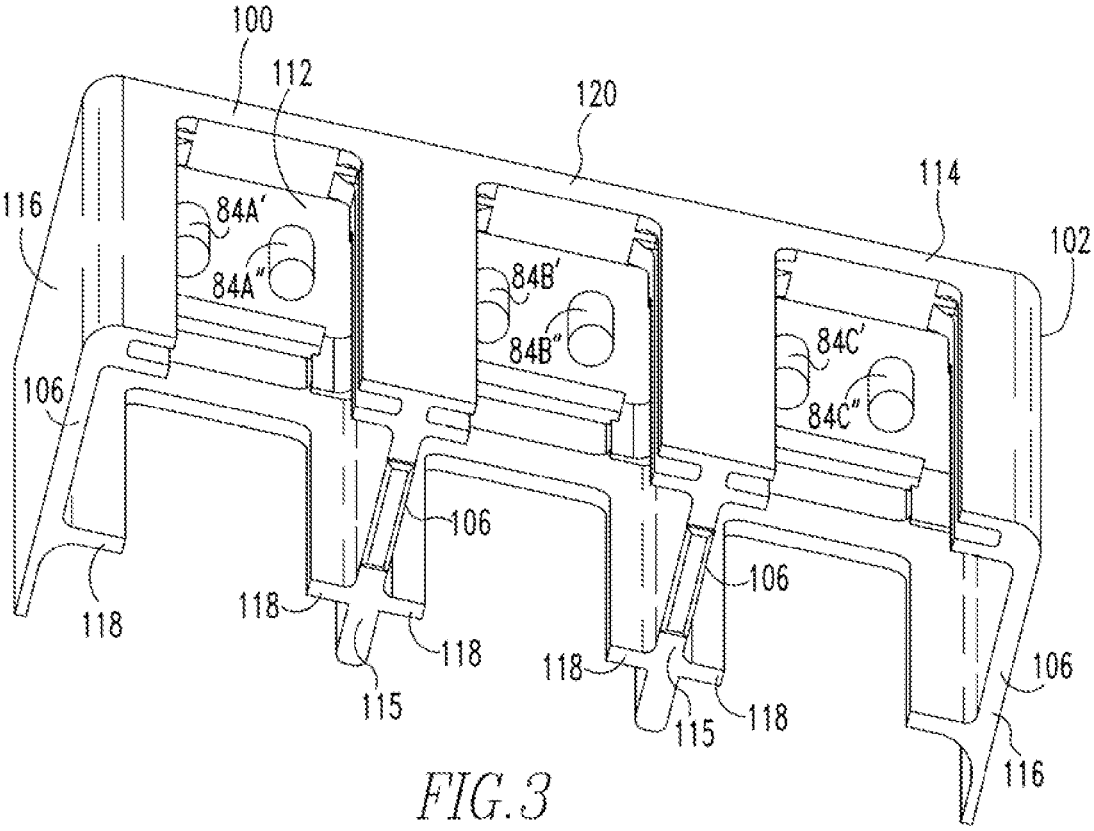
FIG. 3 is an isometric view of a terminal shield having a position indicator.

In one exemplary embodiment, the position indicator 80 is disposed on a terminal shield 100, shown in FIG. 3, A terminal shield 100 is a non-conductive cover structured to be disposed over the exposed portions of a terminal assembly 50. The terminal shield 100 includes a body 102 having a planar member 104 and a number of planar shield members 106 In an exemplary embodiment having three terminal bodies 52A, 52B, 52C, the terminal Shield 100 includes four planar shield members 106. The terminal shield body planar member 104 is structured to correspond to the housing assembly body 30. That is, the terminal shield body planar member 104 has a width that is similar to the width of the housing assembly body 30. Further, terminal shield body planar member 104 has an upper surface 110, a lower surface 112, and a perpendicular surface 114 extending between the upper and lower surface 110, 112. The shield members 106 extend from, and are generally perpendicular to, the planar member lower surface 112. The shield members 106 are structured to extend between, or on the outer lateral sides of, the three terminal bodies 52A. 52B, 52C. That is, there are a number of inner shield members 115 and a number of outer shield members 116. It is understood that in an embodiment with more terminal bodies 52 there would be more inner shield members 115 and in an embodiment with fewer terminal bodies 52 there would be fewer inner shield members 115. The shield members 106 have a length generally similar to the depth of the housing assembly body 30 depth. The inner shield members 115 are structured to be disposed in the gaps between the terminals 51. The outer shield members 116 are structured to extend over the lateral sides of the terminal assembly 50 when the indicator member 82 is in the second position, as described below. The shield members 106 may include a laterally extending flange 118. Each shield member flange 118 is structured to extend partially over an adjacent terminal body 52 when the indicator member 82 is in the second position. In this configuration, the shield members 106 partially enclose the terminals 51.

In the embodiment with three terminal bodies 52A, 52B, 52C, there are two inner shield members 115 and two outer shield members 116. The inner shield members 115 are disposed on either side of the central terminal body 528 and the outer shield members 116 extend over the outer lateral sides of the outer two terminal bodies 52A, 52C.

The indicator member 82 may be disposed on, or incorporated into, the terminal shield body planar member 104. The indicator member 82 may be unitary with the terminal shield body planar member 104. As used herein, the description of the indicator member 82 being "disposed on" the terminal shield body planar member 104, or more specifically the terminal shield body planar member upper surface 110, shall mean the indicator member 82 is either a separate element coupled to the terminal shield body planar member 104, or, the indicator member 82 is incorporated into the terminal shield body planar member 104.

In the embodiment including a terminal shield 100 as described above, the terminal shield body planar member upper surface 110 is the indicator member's 82 alignment surface 86. The spacer member 84, and more specifically three spacer members 84A, 84B, 84C, are coupled to the indicator member 82 and extend away from the indicator member alignment surface 86. Each spacer member 84 is an elongated rod and, in an exemplary embodiment there are three pairs of spacer members 84A', 84A", 84B', 84B" 84C', 84C". Each pair of spacer members 84A', 84A", 84B', 84B" 84C', 84C" is associated with one terminal body 52A, 52B, 52C as described below. The pairs of spacer members 84A', 84A", 84B', 84B" 84C', 84C" are disposed between the shield, members 106. In this configuration, when the terminal shield 100 is coupled to the housing assembly body 30, the pairs of spacer members 84A', 84A", 84B', 84B" 84C', 84C" are aligned with the terminal screws 54 of an associated terminal body 52A, 528, 52C. That is, the spacer members 84A', 84A", 84B', 84B" 84C', 84C" are "associated" with the terminal body 52A, 52B, 52C that includes the terminal screw 54 that is aligned with the spacer members 84A', 84A", 84B', 84B" 84C', 84C".

Thus, the terminal shield 100 is slidably coupled to the housing assembly body first end 38 and is structured, to move between a first position, shown in FIG. 4, wherein the terminal shield body planar member upper surface 110 is not generally aligned with the housing assembly body upper surface 36, and a second position, shown in FIG. 5, wherein the terminal shield body planar member tipper surface 110 is generally aligned with the housing, assembly body upper surface 36. It is noted that the external conductors 70 are not shown in FIGS. 4 and 5 for clarity. It is further noted that because the pairs of spacer members 84A', 84A", 84B', 84B" 84C', 84C" are aligned with the terminal screws 54, the terminal shield 100 cannot move into the second position if any one of the terminal screws 54 is in the first position. This inability to move fully into the terminal shield 100 second position is indicated by the position indicator 80.

That is, in this exemplary embodiment, the indicator member 82 is coextensive with the indicator member alignment surface 86. The indicator member 82 is structured to move between a first position, wherein the indicator member alignment surface 86 is not aligned with the housing assembly body alignment surface 88, and a second position, wherein the indicator member alignment surface 86 is aligned with the housing assembly body alignment surface 88. More specifically, the spacer members 84A', 84A", 84B', 84B" 84C', 84C" have a sufficient length so that When any one of the terminal screws 54 is in the first position, i.e. not set, and the terminal shield 100 is moved toward the second position, the spacer members 84A', 84A", 84B', 84B" 84C', 84C" engage the terminal screw 54 and the spacer members 84A', 84A", 84B', 84B" 84C', 84C" prevent the terminal shield 100 from moving into the terminal shield 100 second position. Because the indicator member 82 is disposed on the terminal shield 100, this further means that if the spacer members 84A', 84A", 84B', 84B" 84C', 84C" engage a terminal screw 54 and, if the terminal screw 54 is in the terminal screw 54 first position, the spacer members 84A', 84A", 84B', 84B" 84C', 84C" prevent the indicator member 82 from moving into the indicator member 82 second position. Thus, each spacer member 84A', 84A", 84B', 84B" 84C', 84C" engages the aligned terminal screw 54 when the terminal screw 54 is in the terminal screw first position and the spacer member 84A', 84A", 84B', 84B" 84C', 84C" aligned with a terminal screw 54 in the terminal screw first position prevents the indicator member 82 from moving into the indicator member second position.

In this embodiment, the user may easily identify when the indicator member 82 is in the first position because the indicator member alignment surface 86 and the housing assembly body alignment surface 88 are not aligned. That is, the terminal shield body planar member upper surface 110 is not generally aligned with the housing assembly body upper surface 35. Thus, even when the terminal screws 54 are covered by the terminal shield 100, a user may determine when any one of the terminal screws 54 is in the first position, i.e. not set, because the terminal shield 100, and more specifically the indicator member 82, cannot move into its second position. When a user identifies such a problem, the user may remove the terminal shield 100 and tighten the terminal screws 54, i.e. move the terminal screws 54 into the second position. When the terminal screws 54 are in the second position, the user reinstalls the terminal shield 100 and moves it to the terminal shield 100 second position. So long as the terminal screws 54 are in the second position, the terminal shield 100, and more specifically the indicator member 82, will move into their respective second positions.

It is noted that the terminal shield body planar member perpendicular surface 114 at the interface of the housing assembly body 30 and the terminal shield 100 may include a contrasting color 120. The terminal shield body planar member perpendicular surface 114 may be, but is not limited to, a color such as red. Generally, the housing assembly body 30 and the terminal shield 100 will be a neutral color such as, but not limited to, white, black, beige, or tan. As such, a terminal shield body planar member perpendicular surface 114 that is red, or any other high contrast color, will be easily visible. In this embodiment, the terminal shield body planar member perpendicular surface 114 is the, or a part of the, indicator member 82. That is, as the terminal shield body planar member perpendicular surface 114 is exposed when the terminal shield 100 is in the first position and is not exposed when the terminal shield 100 is in the second position, the terminal shield body planar member perpendicular surface 114 also acts as part of the indicator member 82.

It is noted that, in this exemplary embodiment, the terminal shield 100 moves in a direction generally perpendicular to the terminal shield body planar member lower surface 112. In such a configuration, the spacer members 84 extends from, and are generally perpendicular to, the terminal shield body planar member lower surface 112. It is understood that, if the terminal shield 100 moved in a direction angled to the terminal shield body planar member lower surface 112, then the spacer members 84 would extend a direction angled to the terminal shield body planar member lower surface 112. That is, the spacer members 84 extend from the terminal shield body planar member lower surface 112 in the direction the terminal shield 100 moves when moving between the terminal shield 100 first and second position.

Figure 6A:
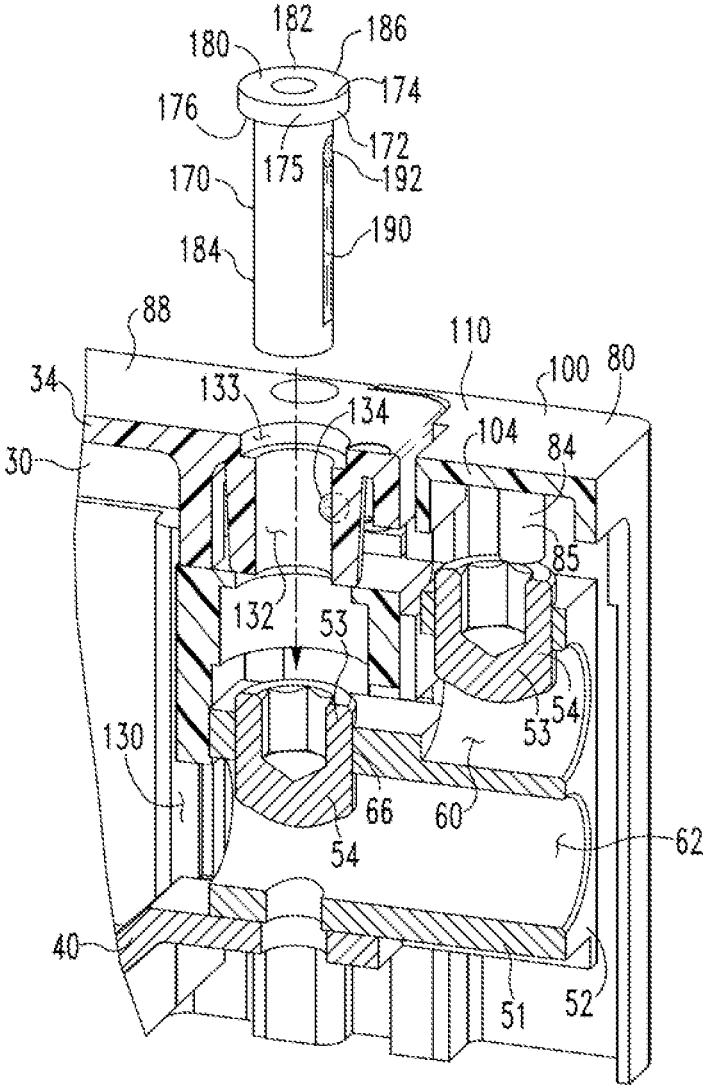
FIGS. 6A and 6B are isometric views of an alternate position indicator.
Figure 6B:
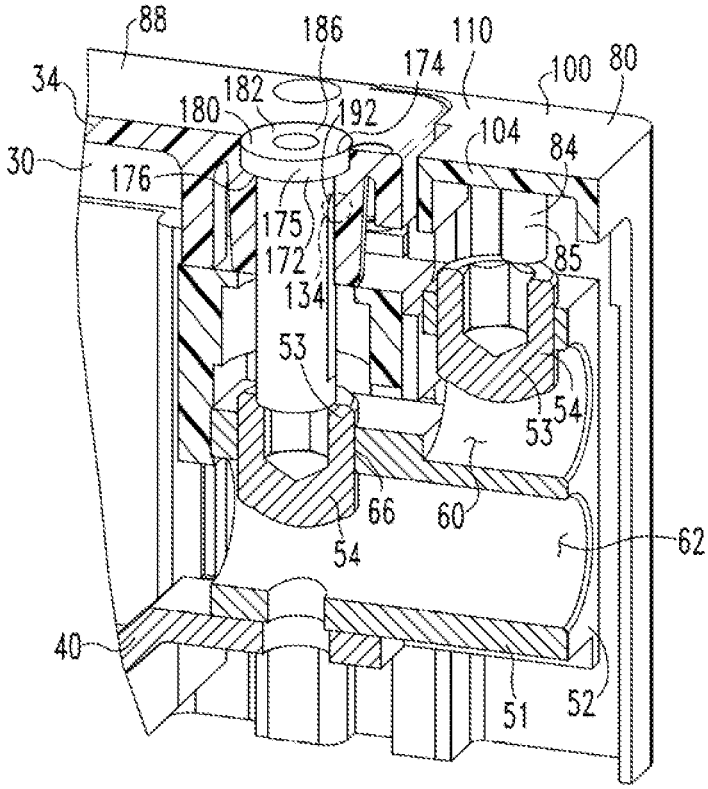

In another exemplary embodiment, shown in FIGS. 6A and 6B, each terminal 51 is disposed in a cavity 130 in the housing assembly body 30. A single cavity 130 and terminal 51 is shown, but it is understood that the housing assembly body 30 may include additional cavities and terminals. In this exemplary embodiment, the housing assembly body 30 includes a bore 132 that provides access to the terminal screw 54. The bore 132, in one exemplary embodiment, includes a recess 133 at the housing assembly body 30, and more specifically the cover 34, generally planar upper surface 36. The bore 132 may include an inwardly extending "ball" 134, Le, a hemisphere, as discussed below.

In this embodiment, the position indicator 180 is a hollow, tubular body 170 having an outwardly extending flange 172 at the upper end. The flange includes an upper surface 174 and a lower surface 176 and a perpendicular surface 175 extending between the flange upper surface 174 and the flange lower surface 176. The inner diameter of the hollow tubular body 170 is slightly smaller than the diameter of the head on the terminal screw 54. In this configuration, a screwdriver may pass through the hollow tubular body 170 and act upon the terminal screw 54. The flange 172 is sized to fit within the recess 133. That is, the recess 133 and the flange 172 have a corresponding shape so that the flange 172 may be seated in the recess 133 with the flange upper surface 174 generally aligned with the housing assembly body 30, and more specifically the cover 34, generally planar upper surface 36.

In one exemplary embodiment, the flange 172 is the indicator member 182 and the flange upper surface 174 is the indicator member alignment surface 186. The tubular body 170 is the spacer member 184. That is, the tubular body 170 is movably disposed in the bore 132. The tubular body 170 moves axially in the bore 132 between a first position, wherein the flange upper surface 174 is not aligned with the housing assembly body alignment surface 88, and a second position, wherein the flange upper surface 174 is generally aligned with the housing assembly body alignment surface 88.

As before, the spacer member 184, i.e. the tubular body 170, extends away from the indicator member 182, i.e. the flange 172, toward the terminal screw 54. When the terminal screw 54 is in the first position, the spacer member 184, i.e. the tubular body 170, will engage the terminal screw 54 when the indicator member 182, i.e. the flange 172, is moved toward the second position. That is, if the terminal screw 54 is in the first position, the spacer member 184, i.e. the tubular body 170, will engage the terminal screw 54 and prevent the indicator member 182, i.e. the flange 172 from moving into the second position. As noted above, a user may easily identify when the two alignment surfaces 186, 88 are not generally aligned. The lack of alignment of the two alignment surfaces 186, 88 indicates that the terminal screw 54 is not in the second position. Further, as before, the flange perpendicular surface 175 may be a high contrast color. The flange perpendicular surface 175 is also visible when the indicator member 182 is in the first position.

If the bore 132 does not include a recess 133, the indicator member 182 still operates in a similar manner, except the flange lower surface 176 is the indicator member alignment surface 186. In this exemplary embodiment, the two alignment surfaces 186, 88 are generally aligned when the flange lower surface 176 abuts the housing assembly body upper surface 36. Thus, the tubular body 170 moves axially in the bore 132 between a first position, wherein the flange lower surface 176 is not aligned with the housing assembly body alignment surface 88, and a second position, wherein the flange lower surface 176 is generally aligned with the housing assembly body alignment surface 88.

The bore 132 may include an inwardly extending ball 134 and the outer surface of the tubular body 170 may include a groove 190. The ball 134 is disposed in the groove 190 and traps the tubular body 170 in the bore 132. Further, the groove 190 may include a detent 192. The detent 192 is positioned so that when the indicator member 182 is in the second position, the ball 134 is in the detent 192. In this configuration, the user may push down on the position indicator 180 and, if it is able to move into the second position, the user will feel the ball 134 move into the detent 192.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A position indicator for a circuit breaker, the circuit breaker including a housing assembly, the circuit breaker housing assembly including a body, a terminal assembly including a terminal and an elongated terminal fastener, the housing assembly body including an alignment surface, the terminal including a body defining a terminal fastener passage and a conductor passage, the terminal fastener disposed in the terminal fastener passage and structured to move between two positions, a first position, wherein the terminal fastener is not set, and a second position, wherein the terminal fastener is set, the position indicator comprising:

an indicator member including an alignment surface;

an elongated spacer member;

the spacer member coupled to the indicator member and extending away from the indicator member alignment surface;

the indicator member movably coupled to the circuit breaker housing assembly adjacent the terminal fastener with the spacer member generally aligned with the terminal fastener;

the indicator member structured to move between a first position, wherein the indicator member alignment surface is not aligned with the housing assembly body alignment surface, and a second position, wherein the indicator member alignment surface is generally aligned with the housing assembly body alignment surface; and wherein the spacer member engages the terminal fastener when the terminal fastener is in the terminal fastener first position and the spacer member prevents the indicator member from moving into the indicator member second position.

2. The position indicator of claim 1 wherein the circuit breaker housing assembly includes a terminal shield movably coupled to the housing assembly body, the terminal shield structured to move between a first position and a second position, and wherein:

the indicator member is disposed on the terminal shield.

3. The position indicator of claim 1 wherein the circuit breaker housing assembly body includes a generally planar upper surface and the terminal shield includes a generally planar member having a generally planar upper surface and a generally planar lower surface, and wherein:

the indicator member is disposed on the terminal shield planar member upper surface.

4. The position indicator of claim 3 wherein:

the spacer member includes a generally cylindrical body; and the spacer member extends from, and is generally perpendicular to, the terminal shield body planar member lower surface.

5. The position indicator of claim 4 wherein there are two spacer members, each spacer member including a generally cylindrical, elongated body.

6. position indicator of claim 3 wherein the terminal shield body planar member includes a perpendicular surface extending, between the upper and lower surface and wherein the indicator member includes a contrasting color on the terminal shield planar member perpendicular surface.

7. A circuit breaker housing assembly comprising:

a housing assembly body including an alignment surface;

an elongated terminal fastener coupled to the housing assembly body, the terminal fastener structured to move between two positions, a first position, wherein the terminal fastener is not set, and a second position, wherein the terminal fastener is set;

a position indicator including an indicator member and an elongated spacer member;

the indicator member including an alignment surface;

the spacer member coupled to the indicator member and extending away from the indicator member alignment surface;

the indicator member movably coupled to the housing assembly body adjacent the terminal fastener with the spacer member aligned with the terminal fastener;

the indicator member structured to move between a first position, wherein the indicator member alignment surface is not aligned with the housing assembly body alignment surface, and a second position, wherein the indicator member alignment surface is generally aligned with the housing assembly body alignment surface; and wherein the spacer member engages the terminal fastener when the terminal fastener is in the terminal fastener first position and the spacer member prevents the indicator member from moving, into the indicator member second position.

8. The circuit breaker housing assembly of claim 7 further comprising:

a terminal assembly including a terminal and the terminal fastener;

the terminal including a body defining a terminal fastener passage and a conductor passage;

the terminal assembly coupled to the housing assembly body; and the terminal fastener directly coupled to the terminal body fastener passage.

9. The circuit breaker housing assembly of claim 7 further comprising:

a terminal shield movably coupled to the housing assembly body, the terminal shield structured to move between a first position and a second position; and the indicator member disposed on the terminal shield.

10. The circuit breaker housing assembly of claim 9 wherein:

the housing assembly body includes a generally planar upper surface and a first end, the housing assembly body first end extending generally perpendicular to the housing assembly body upper surface;

the alignment surface disposed on the housing assembly body upper surface adjacent the housing assembly body first end;

the terminal shield including a generally planar member having a generally planar upper surface and a generally planar lower surface;

the indicator member disposed on the terminal shield planar member upper surface; and the terminal shield slidably coupled to the housing assembly body first end and structured to move between a first position, wherein the terminal shield upper surface is not generally aligned with the housing assembly body upper surface, and a second position, wherein the terminal shield upper surface is generally aligned with the housing assembly body upper surface.

11. circuit breaker housing assembly of claim 10 wherein:

the spacer member includes a generally cylindrical body; and the spacer member extends from, and generally perpendicular to, the planar member lower surface.

12. The circuit breaker housing assembly of claim 11 wherein there are two spacer members, each spacer member including a generally cylindrical, elongated body.

13. The circuit breaker housing assembly of claim 10 wherein:

the terminal shield planar member includes a perpendicular surface extending between the upper and lower surface; and wherein the indicator member includes a contrasting color on the terminal shield planar member perpendicular surface.

14. A terminal shield for a circuit breaker housing assembly, the circuit breaker housing assembly including a body, the housing assembly body including an alignment surface and a first end, a terminal assembly including three terminals including a first terminal, a second terminal, and a third terminal, each terminal including an elongated terminal fastener, each terminal body defining a fastener passage and a conductor passage, each terminal fastener disposed in a terminal fastener passage, each terminal fastener structured to move between two positions, a first position, wherein the terminal fastener is not set, and a second position, wherein the terminal fastener is set, each terminal coupled to the housing assembly body first end and disposed in a spaced parallel relationship, the terminal shield comprising:

a terminal shield body including a generally planar member having an upper surface and a lower surface;

an indicator member including an alignment surface disposed on the terminal shield body planar member upper surface;

three elongated spacer members;

each spacer member coupled to the indicator member and extending away from the indicator member alignment surface;

the planar member movably coupled to the circuit breaker housing assembly adjacent the terminal fastener with each spacer member aligned with the terminal fastener;

the indicator member structured to move between a first position, wherein the indicator member alignment surface is not aligned with the housing assembly body alignment surface, and a second position, wherein the indicator member alignment surface is generally aligned with the housing assembly body alignment surface; and wherein each spacer member engages the aligned terminal fastener when the terminal fastener is in the terminal fastener first position and the spacer member aligned terminal fastener in the terminal fastener first position prevents the indicator member from moving into the indicator member second position.

15. The terminal shield of claim 14 wherein:

the spacer member includes a generally cylindrical body; and the spacer member extends from, and generally perpendicular to, the planar member lower surface.

16. The terminal shield of claim 14 wherein each sparer member includes a generally cylindrical, elongated body.

17. The terminal shield of claim 14 wherein:

the terminal shield planar member includes a perpendicular surface extending, between the upper and lower surface; and wherein the indicator member includes a contrasting color on the terminal shield planar member perpendicular surface.

18. The terminal shield of claim 14 wherein:

the terminal shield body includes a number of planar shield members extending from, and generally perpendicular to, the planar member lower surface:

the shield members including a number of inner shield members and outer shield members:

wherein the inner shield members are structured to be disposed in the gaps between the terminals in a spaced parallel relationship; and wherein the outer shield members are structured to extend over the lateral sides of the terminal assembly when the indicator member is in the second position.

19. The terminal shield of claim 18 wherein:

the shield members include a laterally extending flange; and each shield member flange structured to extend partially over an adjacent terminal body when the indicator member is in the second position.

* * * * *